US008991187B2

(12) United States Patent
Hughes et al.

(10) Patent No.: US 8,991,187 B2
(45) Date of Patent: Mar. 31, 2015

(54) COMBUSTOR WITH A LEAN PRE-NOZZLE FUEL INJECTION SYSTEM

(75) Inventors: Michael John Hughes, Greenville, SC (US); Jonathan Dwight Berry, Greenville, SC (US); Jason Thurman Stewart, Greenville, SC (US); Almaz Valeev, Moscow (RU); Chunyang Wu, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1054 days.

(21) Appl. No.: 12/901,648

(22) Filed: Oct. 11, 2010

(65) Prior Publication Data

US 2012/0085100 A1 Apr. 12, 2012

(51) Int. Cl.

| | |
|---|---|
| ***F02C 1/00*** | (2006.01) |
| ***F02G 3/00*** | (2006.01) |
| ***F23R 3/28*** | (2006.01) |
| ***F23R 3/36*** | (2006.01) |

(52) U.S. Cl.

CPC . *F23R 3/286* (2013.01); *F23R 3/36* (2013.01); *F23C 2900/07001* (2013.01); *F23C 2900/9901* (2013.01)

USPC ..... 60/740; 60/737; 60/742; 60/748; 60/756; 60/757; 60/758

(58) Field of Classification Search

USPC ..... 60/737–740, 742, 748, 756–758

See application file for complete search history.

(56) References Cited

U.S. PATENT DOCUMENTS

| | | | | |
|---|---|---|---|---|
| 4,955,191 | A | 9/1990 | Okamoto et al. | |
| 5,069,029 | A | 12/1991 | Kuroda et al. | |
| 5,081,843 | A | 1/1992 | Ishibashi et al. | |
| 5,127,229 | A | 7/1992 | Ishibashi et al. | |
| 5,450,725 | A | 9/1995 | Takahara et al. | |
| 5,473,881 | A | 12/1995 | Kramnik et al. | |
| 5,551,228 | A | 9/1996 | Mick et al. | |
| 5,901,555 | A * | 5/1999 | Mandai et al. | 60/747 |
| 5,974,781 | A | 11/1999 | Correa et al. | |
| 6,058,710 | A | 5/2000 | Brehm | |
| 6,237,343 | B1 | 5/2001 | Butler | |
| 6,240,732 | B1 | 6/2001 | Allan | |
| 6,327,861 | B2 | 12/2001 | Sato et al. | |
| 6,912,854 | B2 | 7/2005 | Inoue et al. | |
| 6,935,116 | B2 | 8/2005 | Stuttaford et al. | |
| 6,986,254 | B2 | 1/2006 | Stuttaford et al. | |
| 7,137,256 | B1 | 11/2006 | Stuttaford et al. | |
| 7,631,499 | B2 | 12/2009 | Bland | |
| 7,770,395 | B2 * | 8/2010 | Tanimura et al. | 60/737 |
| 8,234,872 | B2 * | 8/2012 | Berry et al. | 60/737 |
| 8,438,852 | B2 * | 5/2013 | Valeev et al. | 60/739 |
| 2002/0014078 | A1 * | 2/2002 | Mandai et al. | 60/737 |
| 2004/0211186 | A1 | 10/2004 | Stuttaford et al. | |

(Continued)

FOREIGN PATENT DOCUMENTS

| | | | |
|---|---|---|---|
| CN | 1403745 | A | 3/2003 |
| JP | H07119971 | A | 5/1995 |

*Primary Examiner* — Craig Kim

(74) *Attorney, Agent, or Firm* — Sutherland Asbill & Brennan LLP

(57) ABSTRACT

The present application provides for a combustor for combusting a flow of fuel and a flow of air. The combustor may include a number of fuel nozzles, a lean pre-nozzle fuel injection system positioned upstream of the fuel nozzles, and a premixing annulus positioned between the fuel nozzles and the lean pre-nozzle fuel injection system to premix the flow of fuel and the flow of air.

14 Claims, 4 Drawing Sheets

(56) References Cited

U.S. PATENT DOCUMENTS

2004/0226300 A1 11/2004 Stuttaford et al.
2009/0071157 A1 3/2009 Cai
2009/0223228 A1* 9/2009 Romoser ..... 60/776
2009/0320490 A1 12/2009 Nilsson et al.

* cited by examiner

COMBUSTOR WITH A LEAN PRE-NOZZLE FUEL INJECTION SYSTEM

TECHNICAL FIELD

The present application relates generally to gas turbine engines and more particularly relates to a combustor with a lean pre-nozzle fuel injection system for mixing fuel and air upstream of the fuel nozzles.

BACKGROUND OF THE INVENTION

In a gas turbine engine, operational efficiency generally increases as the temperature of the combustion stream increases. Higher combustion stream temperatures, however, may produce higher levels of nitrogen oxide ("$NO_x$") and other types of emissions that may be subject to both federal and state regulation in the United States and also subject to similar regulations abroad. A balancing act thus exists between operating the gas turbine engine in an efficient temperature range while also ensuring that the output of $NO_x$ and other types of regulated emissions remain below the mandated levels.

Several types of known gas turbine engine designs, such as those using Dry Low $NO_x$ ("DLN") combustors, generally premix the fuel flows and the air flows upstream of a reaction or a combustion zone so as to reduce $NO_x$ emissions via a number of premixing fuel nozzles. Such premixing tends to reduce overall combustion temperatures and, hence, $NO_x$ emissions and the like.

Premixing, however, may present several operational issues such as flame holding, flashback, auto-ignition, and the like. These issues may be a particular concern with the use of highly reactive fuels. For example, it is possible for a flame to sustain in the head-end upstream of the fuel nozzles with any significant fraction of hydrogen or other types of fuels. Any type of fuel rich pocket thus may sustain a flame and cause damage to the combustor. Other premixing issues may be due to irregularities in the fuel flows and the air flows.

There is thus a desire for an improved combustor design. Such a combustor design should promote improved fuel-air premixing, particularly with the use of highly reactive fuels. Such combustors designs should promote such good mixing while maintaining emissions below mandated levels and avoiding or limiting issues such as flame holding, flashback, auto-ignition, and the like

SUMMARY OF THE INVENTION

The present application thus provides a combustor for combusting a flow of fuel and a flow of air. The combustor may include a number of fuel nozzles, a lean pre-nozzle fuel injection system positioned upstream of the fuel nozzles, and a premixing annulus positioned between the fuel nozzles and the lean pre-nozzle fuel injection system to premix the flow of fuel and the flow of air.

The present application further concerns a method of providing a number of flows of fuel and a flow of air in a combustor. The method may include the steps of injecting a flow of a premix fuel into a premixing annulus, providing the flow of air into the premixing annulus, premixing the flow of the premix fuel and the flow of air into a premixed flow along the premixing annulus, providing the premixed flow to a number of fuel nozzle, and injecting a further flow of fuel into the premixed flow along the number of fuel nozzles.

The present application further provides a combustor for combusting a flow of fuel and a flow of air. The combustor may include a number of fuel nozzles with each of the fuel nozzles including a bellmouth, a lean pre-nozzle fuel injection system positioned upstream of the fuel nozzles, and a premixing annulus positioned between the fuel nozzles and the lean pre-nozzle fuel injection system to premix the flow of fuel and the flow of air. The premixing annulus may expand in the direction of the fuel nozzles.

These and other features and improvements of the present application will become apparent to one of ordinary skill in the art upon review of the following detailed description when taken in conjunction with the several drawings and the appended claims.

DETAILED DESCRIPTION

Figure 1:
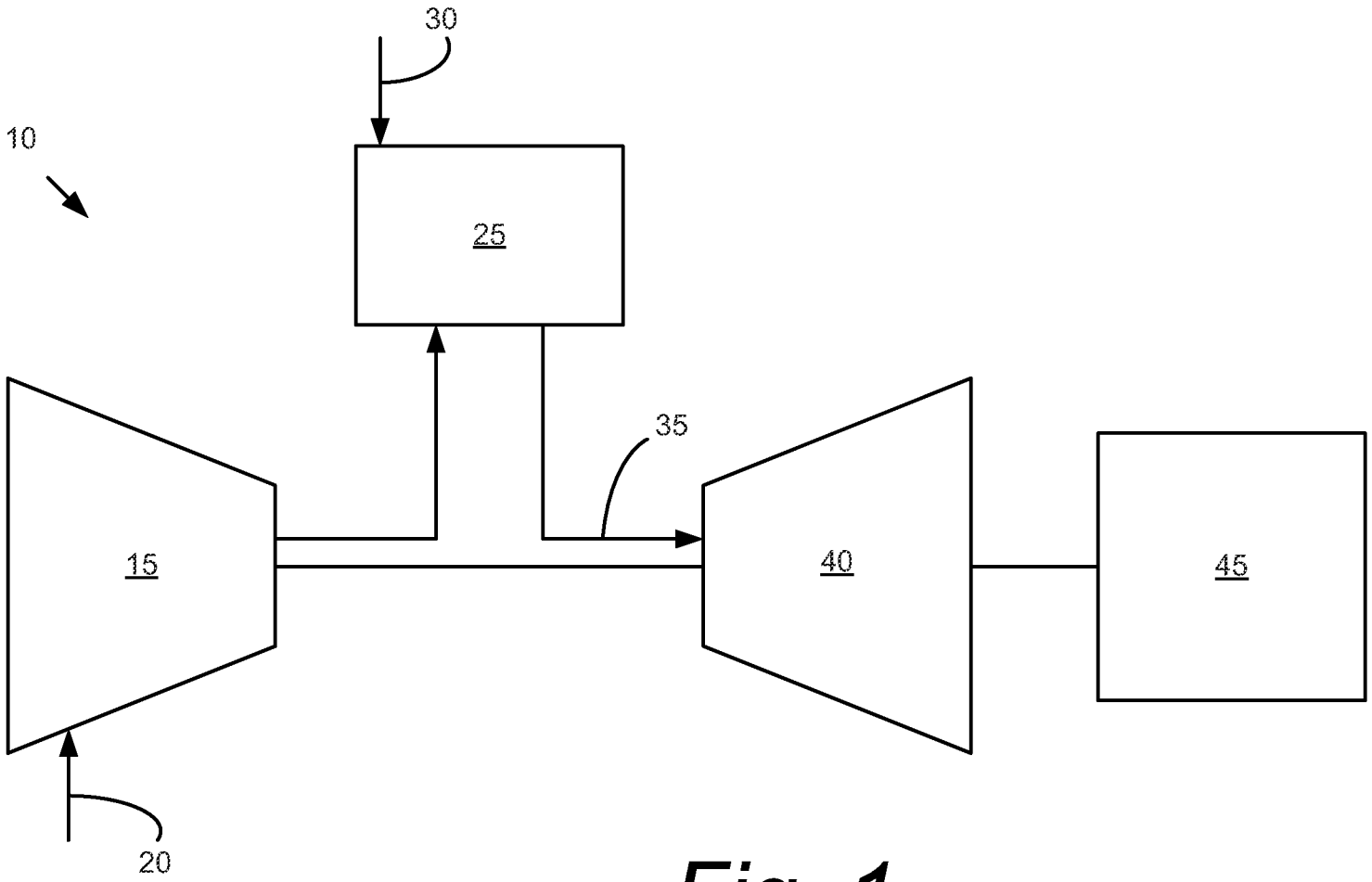
FIG. 1 is a schematic view of a known gas turbine engine.

Referring now to the drawings, in which like numerals refer to like elements throughout the several views, FIG. 1 shows a schematic view of gas turbine engine 10 as may be described herein. The gas turbine engine 10 may include a compressor 15. The compressor 15 compresses an incoming flow of air 20. The compressor delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 and an external load 45 such as an electrical generator and the like.

The gas turbine engine 10 may use natural gas, various types of syngas, and/or other types of fuels. The gas turbine engine 10 may be anyone of a number of different gas turbine engines offered by General Electric Company of Schenectady, N.Y. The gas turbine engine 10 may have different configurations and may use other types of components. Other types of gas turbine engines also may be used herein. Multiple gas turbine engines, other types of turbines, and other types of power generation equipment also may be used herein together.

Figure 2:
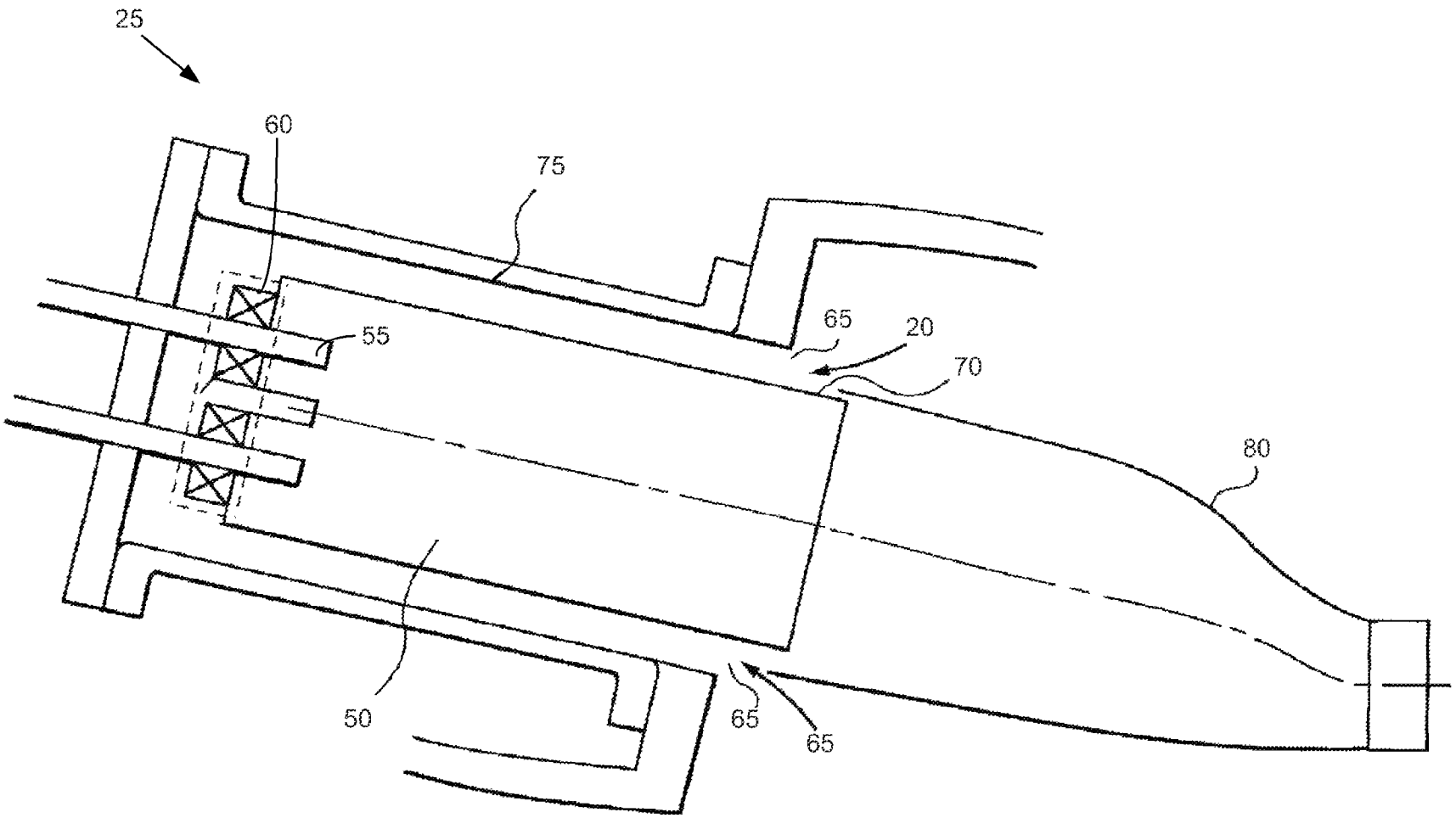
FIG. 2 is a side cross-sectional view of a known combustor.

FIG. 2 shows a simplified example of a known combustor 25. Generally described, the combustor 25 may include a combustion chamber 50 with a number of fuel nozzles 55 positioned therein. The fuel nozzles 55 may be premixing nozzles with one or more swirlers 60 thereon. The swirlers 60 aid in the premixing of the flow of air 20 and the flow of fuel 30. An incoming air path 65 may be defined between a liner 70 of the combustion chamber 50 and a casing 75. A transition piece 80 may be positioned downstream of the combustion chamber 50. Other types of combustor configurations are known.

The flow of air 20 may enter the combustor 25 from the compressor 15 via the incoming air path 65. The flow of air 20 may reverse direction and may be premixed about the fuel nozzles 55 and the swirlers 60 with the flow of fuel 30. The mixed flow of air 20 and the flow of fuel 30 may be combusted within the combustion chamber 50. The flow of combustion gases 35 then may be exhausted through the transition piece 80 towards the turbine 40. Depending upon the nature of the combustor 25, the combustor 25 may use a primary fuel which may be a fuel gas passing through the swirlers 60; a secondary fuel and a tertiary fuel which may be a premixed fuel gas; and a lean pre-nozzle fuel injection system that may inject a small amount of fuel just upstream of the swirlers 60. Other types of fuel circuits and configurations also are known.

Figure 3:
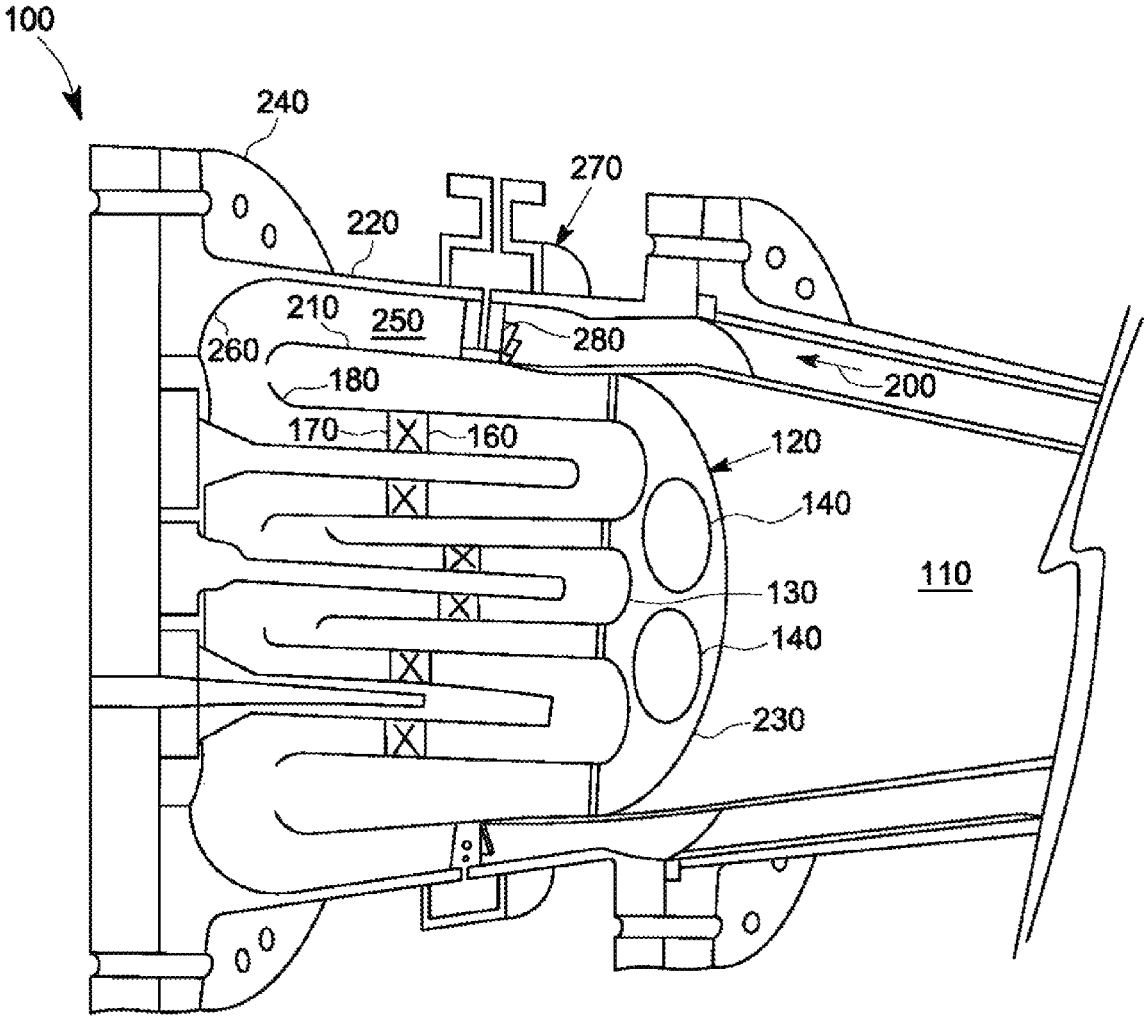
FIG. 3 is a side cross-sectional view of a combustor with a lean pre-nozzle fuel injection system as may be described herein.
Figure 4:
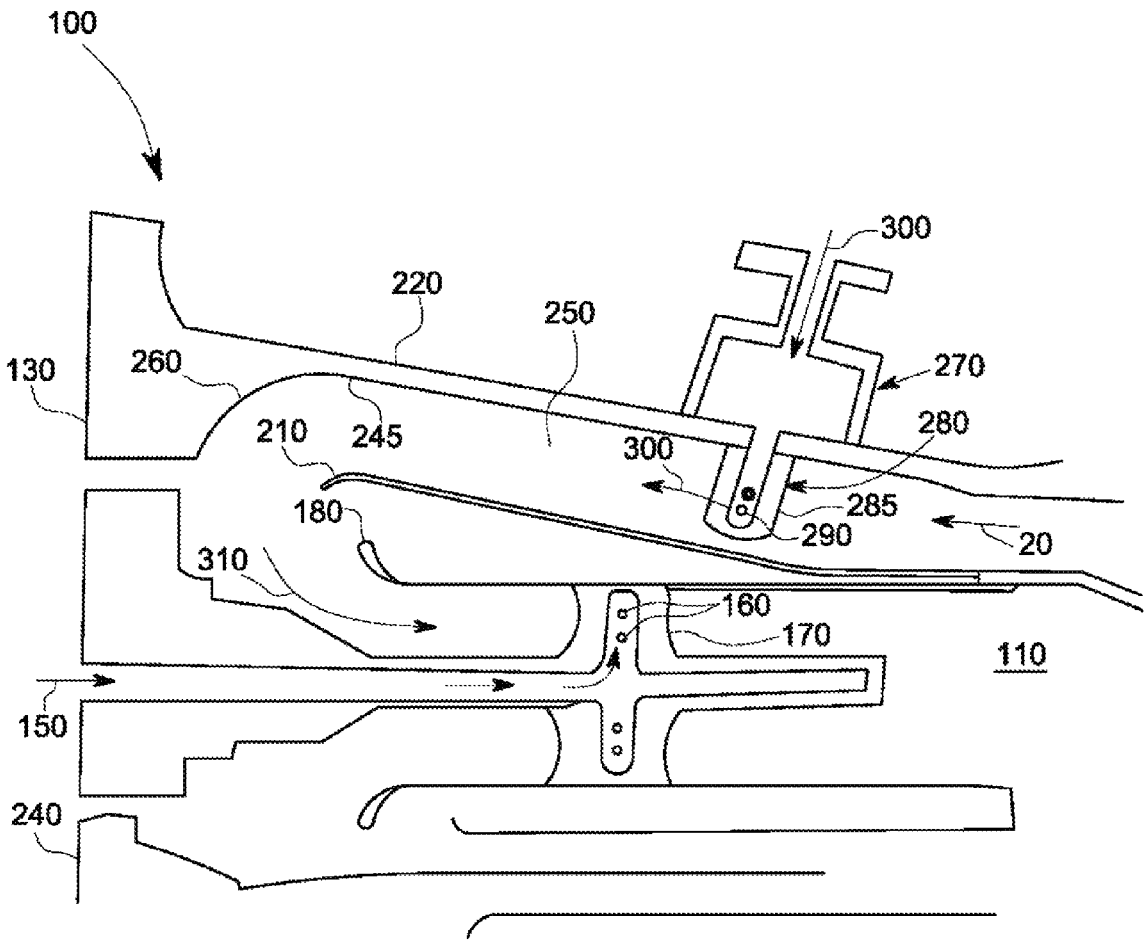
FIG. 4 is a side cross-sectional view of a fuel nozzle for use with the combustor with the lean pre-nozzle fuel injection system of FIG. 3.

FIGS. 3 and 4 show a combustor 100 as may be described herein. Similar to the combustor 25 described above, the combustor 100 includes a combustion chamber 110 with a number of fuel nozzles 120 positioned therein. In this example, a center nozzle 130 may be surrounded by a number of outer nozzles 140. Any number of fuel nozzles 120 may be used herein.

Generally described, each of the fuel nozzles 120 may include a central fuel passage 150, generally for a liquid fuel. The fuel nozzles 120 also may include a number of fuel injectors 160. The fuel injectors 160 may be positioned about one or more swirlers 170. The fuel injectors 160 may be used with a premix fuel and the like. Other types of fuel circuits may be used herein. The fuel nozzles 120 also may include a bellmouth 180 at an upstream end thereof for the incoming flow of air 20. Any number or shape of the bellmouths 180 may be used.

The combustor 100 also includes an incoming air path 200. The incoming air path 200 may be defined between a liner or a cap baffle 210 and a casing 220. The cap baffle 210 may be attached to an end cap 230 and may expand in the direction towards an end cover 240 in a flared shape 245. Likewise, the casing 220 may be flared such that the casing 220 has a larger diameter in the direction of the flow towards the end cover 240. The cap baffle 210 and the casing 220 may define a premixing annulus 250. The overall premixing annulus 250 thus expands towards the end cover 240 as well. The premixing annulus 250 may have a smooth turning portion 260 about the end cover 240 towards the fuel nozzles 120. The premixing annulus 250 may provide diffusion or not. Other configurations may be used herein.

A lean pre-nozzle fuel injection system 270 also may be positioned about the incoming air path 200 between the cap baffle 210 and the casing 220 about the end cap 230. The lean pre-nozzle fuel injection system 270 may have a number of fuel injectors 280. The fuel injectors 280 may have an aerodynamic wing-like or streamlined shape 285 for optimized flame holding resistance. The fuel injectors 280 each may have a number of injector holes 290 therein. The number of fuel injectors 280 and the number of injection holes 290 may be optimized for premixing. Other configurations may be used herein. A premix fuel 300 may flow therein.

In use, the premix fuel 300 is injected via the fuel injectors 280 of the lean pre-nozzle fuel injection system 270 into the incoming flow of air 20 passing through the incoming air path 200. The aerodynamic wing-like shape 285 of the fuel injectors 280 minimizes the risk of holding a flame on or behind the injectors 280. The premix fuel 300 and the flow of air 200 thus premix into a premixed stream 310 along the length of the premixing annulus 250. Because both the cap baffle 210 and the casing 220 expand in the direction towards the end cover 240, the premixing annulus 250 slows the air and recovers some of the static pressure. This flared shape thus allows more diffusion than a typical cylindrical casing. The premixing also removes any rich pockets of fuel that might sustain a flame. The length of the premixing annulus 250 along with the number and the spacing of the injectors 280 thus provide improved premixing within the premixing annulus 250. The premixed stream 310 will be fully mixed before exiting the annulus 250.

The premixed stream 310 then turns about the turning section 260 and enters the fuel nozzles 120. Because the flow of air 200 slows within the premixing annulus 250, the premixed stream 310 turns easily about the turning section 260 into the fuel nozzles 120 without recirculation or flow deficits. As a result, the fuel nozzles 120 may use the bellmouths 180 as opposed to a traditional flow conditioner that may result in a lower pressure drop. The premixed stream 310 further mixes with the conventional flow of fuel 30 from the fuel injectors 160 or otherwise before being combusted in the combustion chamber 110.

The premixing annulus 250 may flow a large percentage of the total fuel flow without negatively impacting emissions. Likewise, by unloading the fuel nozzles 120, i.e., by taking fuel away, overall flame holding performance of the fuel nozzles also may be enhanced. The ability to modulate the percentage of the total fuel delivered to the lean pre-nozzle fuel injection system 270 over a wide range may provide pressure ratio control so as to deal with fluctuations in the fuel composition. The overall pressure ratio of the fuel nozzles 120 may be optimized for dynamics without changing the nozzle equivalent ratio and the like. Moreover, the size of the fuel injectors 160 also may be reduced.

The use of the fuel injectors 280 of the lean pre-nozzle fuel injection system 270 and the premixing annulus 250 thus reduces $NO_x$ emissions, reduces the pressure drop, and provides increased fuel flexibility in terms of both MWI. (Modified Wobbe Index) capability and fuel reactivity. The lean pre-nozzle fuel injection system 270 thus may be fuel flexible including the use of highly reactive fuels such as hydrogen, ethane, propane, etc.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A combustor for combusting a flow of fuel and a flow of air, comprising:

a plurality of fuel nozzles;

a lean pre-nozzle fuel injection system positioned upstream of the plurality of fuel nozzles to premix the flow of fuel and the flow of air; and a casing positioned about a cap baffle, wherein the casing and the cap baffle form a premixing annulus having a length defined between the lean pre-nozzle fuel injection system and a distal end of the cap baffle, wherein the lean pre-nozzle fuel injection system is disposed about an upstream end of the cap baffle, wherein the plurality of fuel nozzles are positioned downstream of the premixing annulus, wherein the lean pre-nozzle fuel injection system is positioned upstream of the premixing annulus, and wherein the distal end of the cap baffle and a corresponding portion of the casing are curved inward towards the plurality of fuel nozzles.

2. The combustor of claim 1, wherein each of the plurality of fuel nozzles comprises a fuel injector and a swirler.

3. The combustor of claim 1, wherein each of the plurality of fuel nozzles comprises a plurality of outer fuel nozzles.

4. The combustor of claim 1, wherein the plurality of fuel nozzles comprises a bellmouth.

5. The combustor of claim 1, wherein the cap baffle and the casing expand in a direction towards an end cover.

6. The combustor of claim 1, wherein the premixing annulus comprises a smooth turning portion adjacent to the plurality of fuel nozzles.

7. The combustor of claim 1, wherein the lean pre-nozzle fuel injection system comprises a plurality of fuel injectors.

8. The combustor of claim 7, wherein each of the plurality of fuel injectors comprises a streamlined wing-like shape.

9. The combustor of claim 7, wherein each of the plurality of fuel injectors comprises a plurality of injector holes.

10. The combustor of claim 4, wherein the distal end of the cap baffle extends beyond the bellmouth.

11. A combustor for combusting a flow of fuel and a flow of air, comprising:

a plurality of fuel nozzles;

a lean pre-nozzle fuel injection system positioned upstream of the plurality of fuel nozzles to premix the flow of fuel and the flow of air;

a casing positioned about a cap baffle, wherein the casing and the cap baffle form a premixing annulus having a length defined between the lean pre-nozzle fuel injection system and a distal end of the cap baffle, wherein the lean pre-nozzle fuel injection system is disposed about an upstream end of the cap baffle, wherein the plurality of fuel nozzles are positioned downstream of the premixing annulus, wherein the lean pre-nozzle fuel injection system is positioned upstream of the premixing annulus; and a bellmouth disposed at an upstream end of the plurality of fuel nozzles, wherein the distal end of the cap baffle extends beyond the bellmouth, and wherein the distal end of the cap baffle and a corresponding portion of the casing are curved inward towards the plurality of fuel nozzles.

12. The combustor of claim 11, wherein the premixing annulus comprises a smooth turning portion adjacent to the plurality of fuel nozzles.

13. The combustor of claim 11, wherein the lean pre-nozzle fuel injection system comprises a plurality of fuel injectors.

14. The combustor of claim 11, wherein each of the plurality of fuel injectors comprises a streamlined wing-like shape.

* * * * *